US012157069B2

(12) United States Patent
Almstead et al.

(10) Patent No.: US 12,157,069 B2
(45) Date of Patent: Dec. 3, 2024

(54) STAND MIXER TOY

(71) Applicant: Melissa & Doug, LLC, Wilton, CT (US)

(72) Inventors: Brett K. Almstead, Ridgefield, CT (US); Matt Burtonwood, West Yorkshire (GB)

(73) Assignee: Melissa & Doug, LLC, Wilton, CT (US)

( * ) Notice: Subject to any disclaimer, the term of this patent is extended or adjusted under 35 U.S.C. 154(b) by 0 days.

(21) Appl. No.: 17/668,137

(22) Filed: Feb. 9, 2022

(65) Prior Publication Data

US 2023/0249094 A1 Aug. 10, 2023

(51) Int. Cl.
*A63H 33/30* (2006.01)

(52) U.S. Cl.
CPC ..... *A63H 33/3055* (2013.01)

(58) Field of Classification Search
CPC .. A63H 33/30; A63H 33/3055; A47J 43/1012
See application file for complete search history.

(56) References Cited

U.S. PATENT DOCUMENTS 817,272 A * 4/1906 Persons ..... F16M 11/10 248/292.12
1,246,103 A * 11/1917 Joinette ..... B01F 27/07 74/16
1,571,851 A * 2/1926 Lyon ..... A47J 43/1012 74/416
1,788,675 A * 1/1931 Johnson ..... A47J 43/1012 248/413
1,822,035 A * 9/1931 Johnson ..... A47J 43/1012 248/157
1,861,808 A * 6/1932 Lionell ..... A47J 45/02 248/175

(Continued)

FOREIGN PATENT DOCUMENTS

CN 204352560 5/2015
CN 205672569 11/2016

(Continued)

OTHER PUBLICATIONS

Translation CN207152506U (Year: 2018).*

(Continued)

*Primary Examiner* — Eugene L Kim
*Assistant Examiner* — Alyssa M Hylinski
(74) *Attorney, Agent, or Firm* — Aird & McBurney LP

(57) ABSTRACT

A toy that simulates a stand mixer provides users, for example, children with the experience of preparing foods. The mixer includes a base shaped to sit on a horizontal surface. A vertical member extends from the base and holds an extension that extends over a portion of the base. A bowl is sized to fit on the base below the extension. The extension includes a semicircular clip aligned with a semicircular slot on the extension. The mixer includes interchangeable tools, such as a whisk, a dough hook, or a paddle blade. The clip and the extension define a circular space to hold a handle of the tool and allow the tool to spin, simulating the mixing action of a stand mixer. The clip flexes away from the extension to allow one tool to be removed and another tool to be connected.

13 Claims, 10 Drawing Sheets

(56) References Cited

U.S. PATENT DOCUMENTS

| | | | | | |
|---|---|---|---|---|---|
| 2,188,701 | A * | 1/1940 | Brullhardt | A47J 43/1012 | 248/176.1 |
| 3,171,636 | A * | 3/1965 | Barlow | A63H 33/30 | 177/229 |
| 5,327,816 | A * | 7/1994 | DuPont | A47J 43/27 | 366/342 |
| 6,224,253 | B1 * | 5/2001 | Dixon | B01F 27/88 | 366/325.92 |
| 2015/0352453 | A1 * | 12/2015 | Sternbach | A63H 3/003 | 446/268 |

FOREIGN PATENT DOCUMENTS

| | | | |
|---|---|---|---|
| CN | 207152506 U | * | 3/2018 |
| CN | 210448110 | | 5/2020 |
| CN | 212039041 | | 12/2020 |
| CN | 212368837 U | * | 1/2021 |
| WO | 2004041395 | | 5/2004 |

OTHER PUBLICATIONS

Translation CN212368837U (Year: 2021).*
European Office Action for Application No. 23155913, completed May 26, 2023.

* cited by examiner

STAND MIXER TOY

BACKGROUND OF THE INVENTION

1. Field of the Invention

The present disclosure relates to a simulated kitchen appliance that provides the experience of preparing food. More particularly, the present disclosure relates to an apparatus that simulates a stand mixer and that safely provides the user with the experience of preparing foods, such as baked goods.

2. Description of the Related Art

Children enjoy playing games where they have the sensation that they are acting as adults. Toys such as simulated cash registers, retail stores, food kiosks, and other structures can provide children with the experience of performing a task normally reserved for adults. Such toys provide entertainment and can help children develop skills, such as arithmetic when making change. Playing games with such toys may help children develop social skills such as speaking politely, responding to questions, and interacting with others as an adult would do in a retail establishment.

The experience of a toy that simulates adult activities may be enhanced where the simulated activity is something children are normally not allowed to do. Toys that allow children to imaging they are driving a car or truck, sailing a boat, or flying a plane may provide a child with a more engaging experience because the activity is something they typically would not be allowed to do because it may be dangerous.

There is a need for a toy that allows children the experience of operating cooking appliances to create foods, such as baked goods. There is also a need for a toy that allows children the experience of working in a food service establishment, such as a bakery.

BRIEF SUMMARY OF THE INVENTION

Embodiments of the disclosure provide a toy that includes a mechanism to simulate the preparation of food. According to one aspect, there is provided a simulated stand mixer that a child can operate to pretend to mix food materials, such as ingredients for baked goods. According to another aspect there is provided a simulated stand mixer with interchangeable tools, such as a whisk, a paddle blade, and a dough hook. According to another aspect there is provided a simulated stand mixer that allows a child to rotate such a tool within a mixing bowl. According to a still further aspect there is provided a simulated stand mixer with interchangeable tools and a removable bowl that provides a child with a realistic experience of operating such an appliance.

According to one embodiment, a toy is provided that comprises a stand formed by a base, a vertically oriented member, and an extension that extends horizontally above an open portion of the base. The open portion is sized so that a mixing bowl can be placed on the open portion below the extension. A clip is disposed on the extension above the open portion. The clip is sized and shaped to hold a simulated mixing tool, such as a dough hook, and position the tool within the mixing bowl. According to one embodiment, the clip allows the tool to be rotated by the child to simulate the operation of the stand mixer.

According to a further embodiment, the open portion of the base includes a bowl receiving mechanism to position the bowl with respect to a tool held by the clip. According to this embodiment, the bottom outside surface of the bowl is shaped to engage with, and be removably held by, the bowl receiving mechanism. According to a further embodiment, the bowl receiving mechanism allows the bowl to rotate, allowing a child to simulate rotating a mixing bowl while operating the stand mixer.

According to another embodiment, a variety of mixing tools can be interchangeably connected with the stand mixer by the clip. The mixing tools may include a dough hook, a paddle blade, a whisk, and the like.

According to another embodiment, the disclosure provides a method for using a simulated stand mixer. A user selects a simulated mixing tool, such as a whisk. The user engages the tool with the clip so that the handle portion of the tool is directed upward and the working portion of the tool, for example the whisk wires, are directed downward. The user fits the bowl onto the base with the working portion of the tool extending into the bowl. The user spins that handle within the clip, rotating the working portion to simulate mixing of materials in the bowl.

According to another aspect of the disclosure, the structure is formed from components that are simple to manufacture and assemble.

According to another aspect of the disclosure, toys embodying the disclosed structure are lightweight and easy to store and transport.

According to another aspect of the disclosure, toys embodying the disclosed structure are durable.

BRIEF DESCRIPTION OF THE DRAWINGS

The above and/or other aspects of the disclosure will be more apparent by describing in detail exemplary embodiments of the disclosure with reference to the accompanying drawings, in which.

DETAILED DESCRIPTION OF EXEMPLARY EMBODIMENTS

Figure 1:
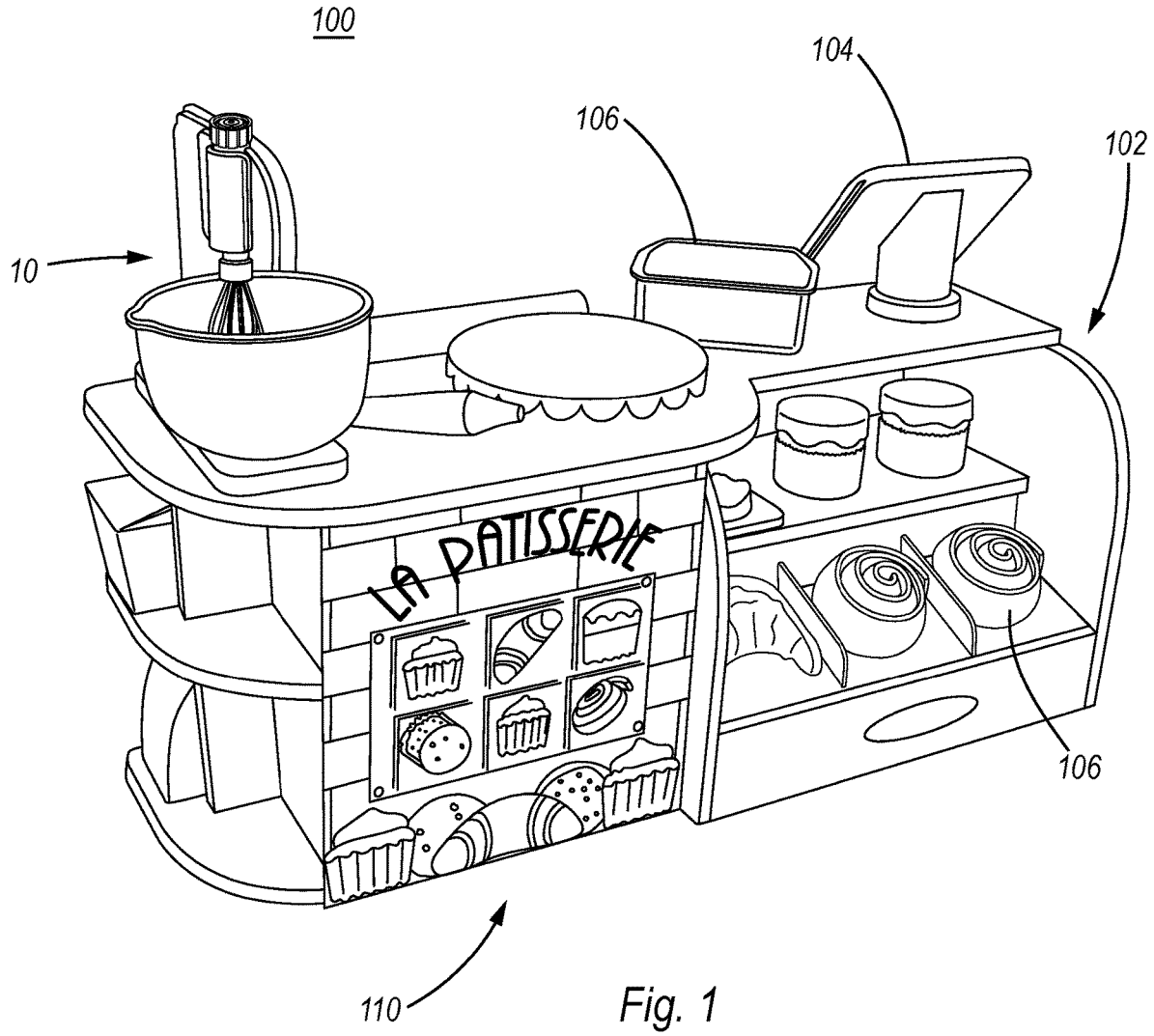
FIG. 1 is a perspective view of a play set including a simulated stand mixer according to embodiments of the disclosure.

Exemplary embodiments of the disclosure will now be described below by reference to the attached Figures. The described exemplary embodiments are intended to assist the understanding of the invention and are not intended to limit the scope of the invention in any way. Like reference numerals refer to like elements throughout.

FIG. 1 shows a toy 100 according to one embodiment of the disclosure. In this exemplary embodiment, the toy simulates the counter of a retail establishment where food is prepared and sold, such as a bakery, a restaurant, a coffee shop, or the like. The toy includes a bench or counter 102. The bench may include decorations suggestive of the retail establishment. In the example, shown in FIG. 1, the bench 102 includes accessories, such as a cash register or point of sale computer screen 104, simulated baked goods 106, and the like. Printing or decals 110 may be provided on bench 102, for example, showing a price list and the like to evoke the sensation of a retail establishment. The disclosure is not limited to a bench or counter including these accessories and encompasses other sorts of accessories and decorations, as well as embodiments without such accessories or decorations.

Figure 2A:
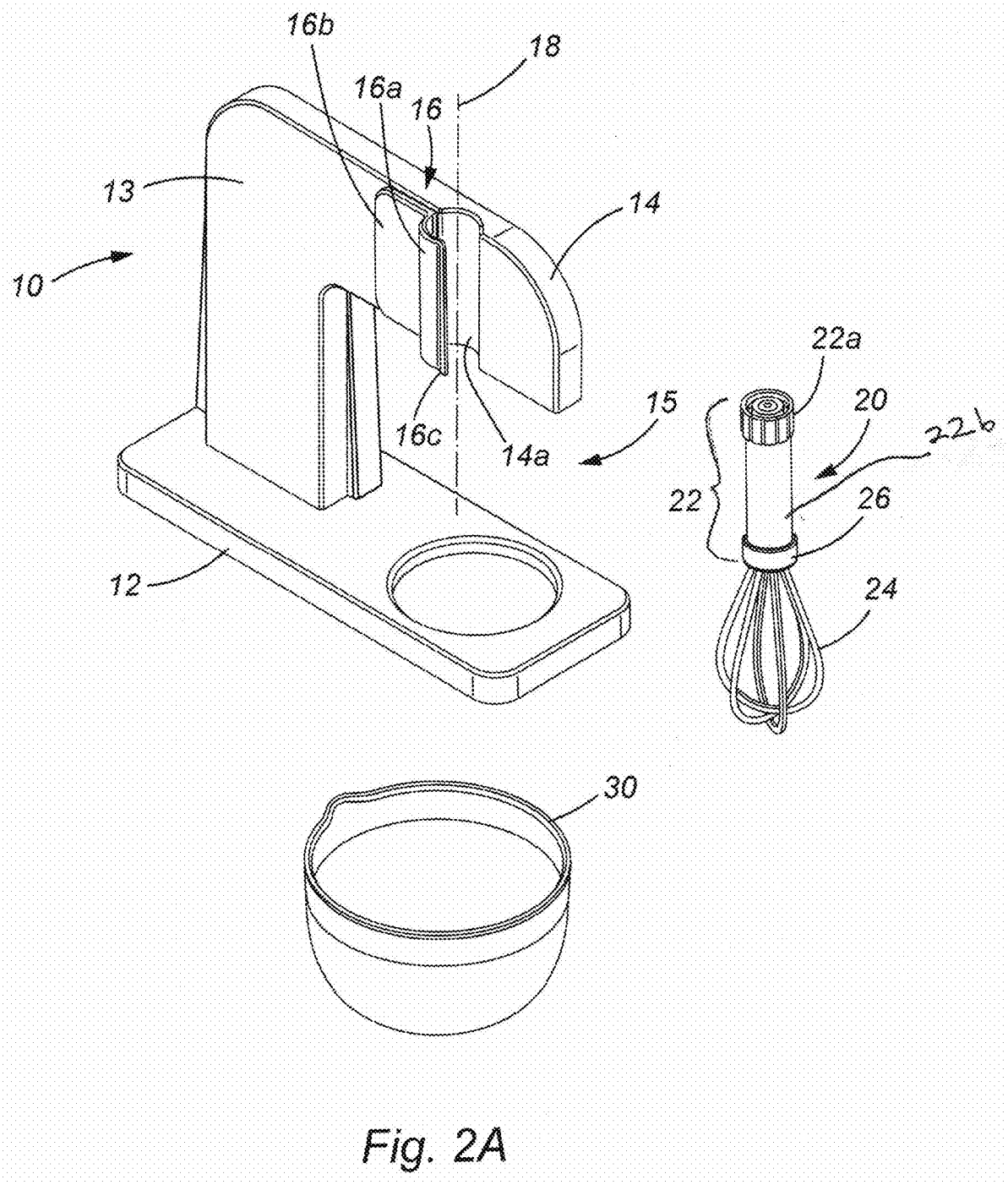
FIGS. 2A and 2B are a perspective views of a stand mixer and removable bowl and tool components according to an embodiment of the disclosure.
Figure 2B:
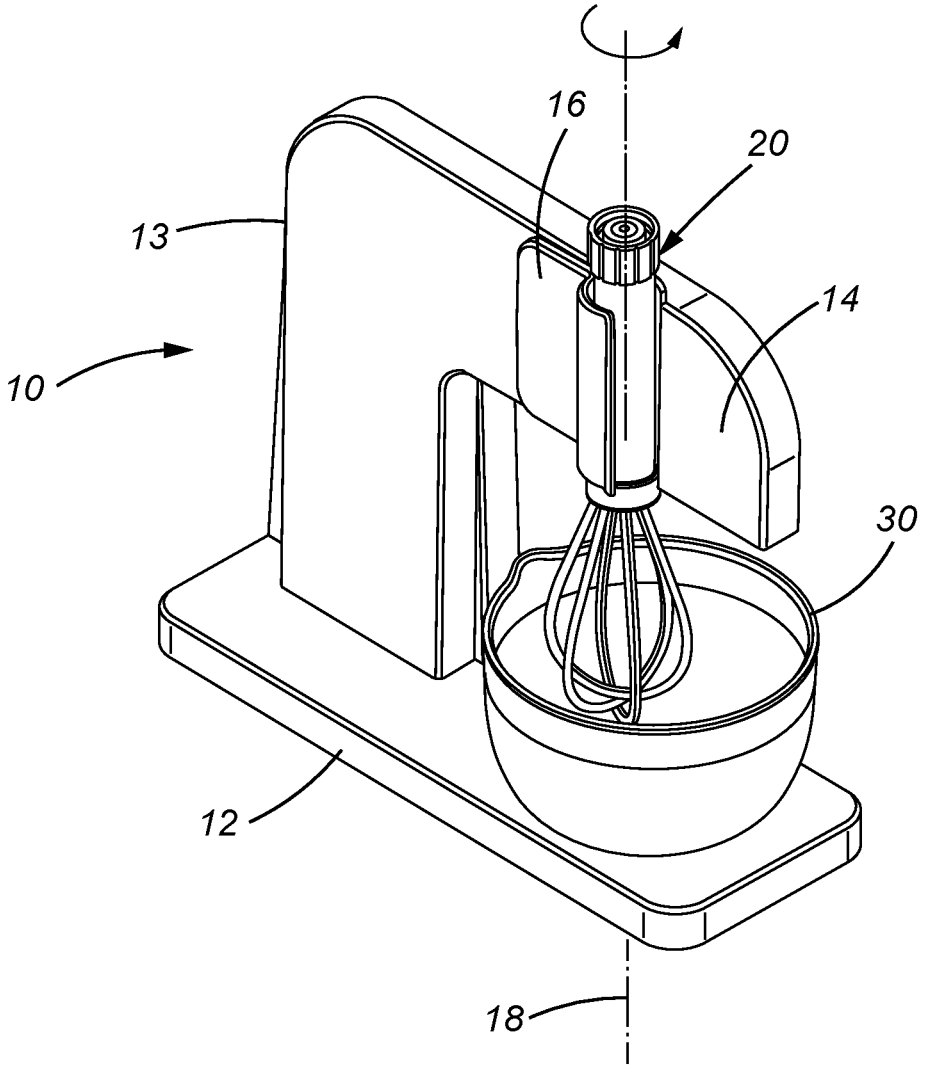

Connected with bench 102 is a simulated stand mixer 10 according to embodiments of the disclosure. FIGS. 2A and 2B show detailed views of mixer 10 according to embodiments of the disclosure. Mixer 10 is formed from a base 12, a vertically member 13, and an extension 14 that extends horizontally from the arm. Below extension 14, a space 15 is provided. Space 15 is sized to allow a user to place a bowl 30 on base 12 below extension 14 as shown in FIG. 2B.

Figure 3:
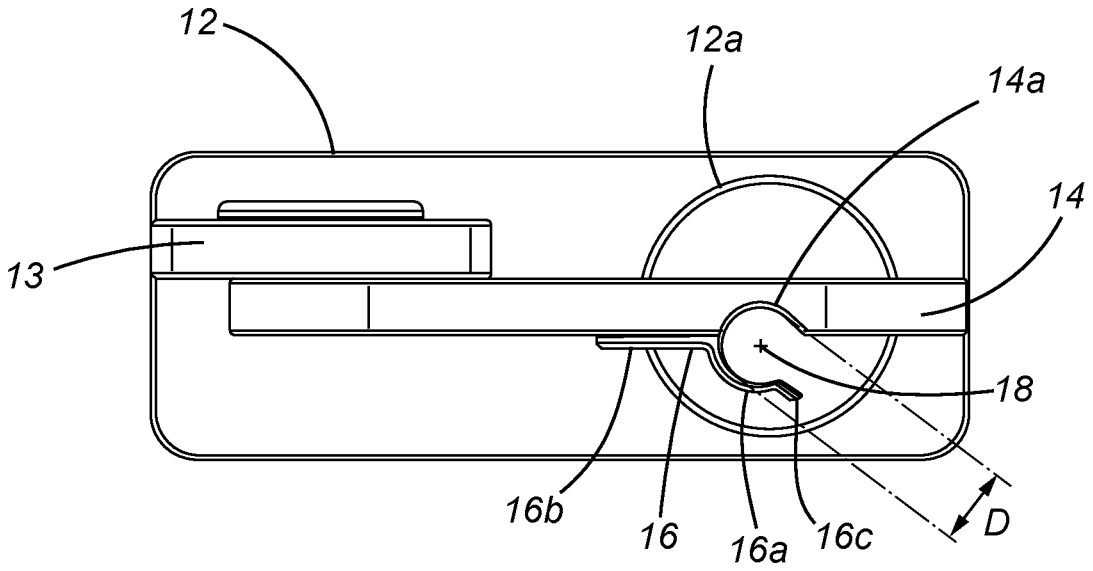
FIG. 3 is a top view of the stand mixer of FIG. 1.

Extension 14 includes a clip 16. Clip 16 includes a semicircular portion 16*a* and a connecting portion 16*b*. Connecting portion 16*b* is connected with the side of extension 14. Semicircular portion 16*a* has an inside surface with a selected radius of curvature and defines a vertical axis 18. Semicircular portion 16*a* of clip 16 is positioned adjacent slot 14*a* on extension 14. Slot 14*a* has the same radius of curvature as semicircular portion 16*a* centered on axis 18. Together, semicircular portion 16*a* and slot 14*a* define a holder diameter D, as shown in FIG. 3. According to one embodiment, clip 16 includes a ramped portion 16*c*. A space is provided between the ramp 16*c* and/or the edge of clip 16 and the surface of extension 14. According to one embodiment, clip 16 is formed from a material that has a selected amount of elasticity to allow the space to widen to accept insertion of a tool 20.

Figure 6A:
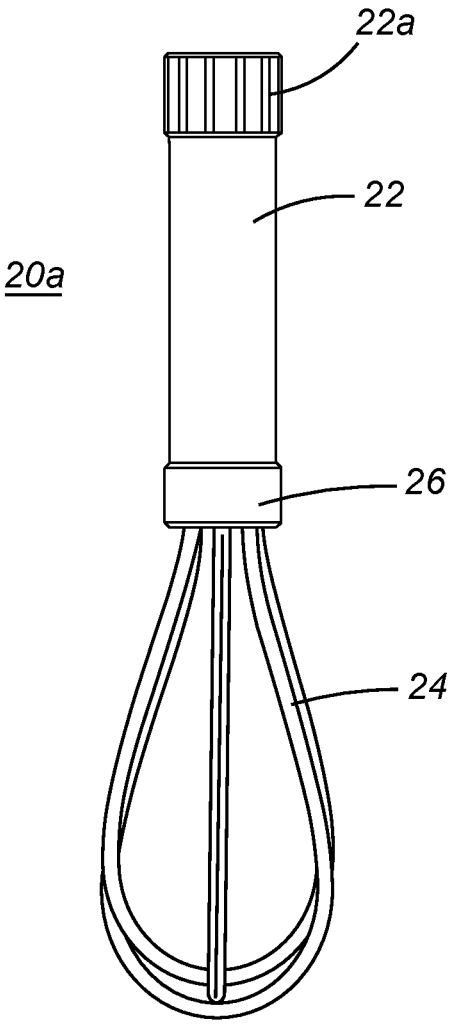
FIGS. 6A, 6B, and 6C are elevation views of a whisk tool, a dough hook tool, and a paddle blade tool, respectively, shaped to removably connect with a simulated stand mixer according to embodiments of the disclosure.
Figure 6B:
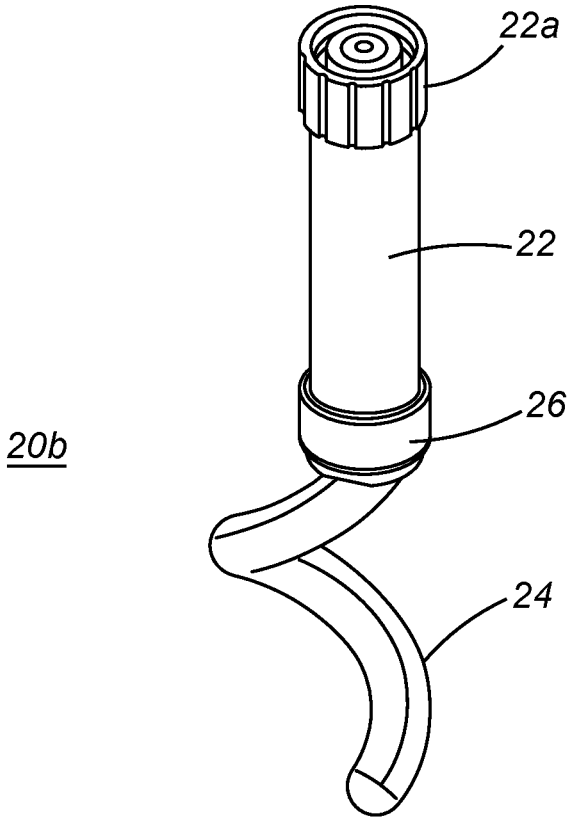
Figure 6C:
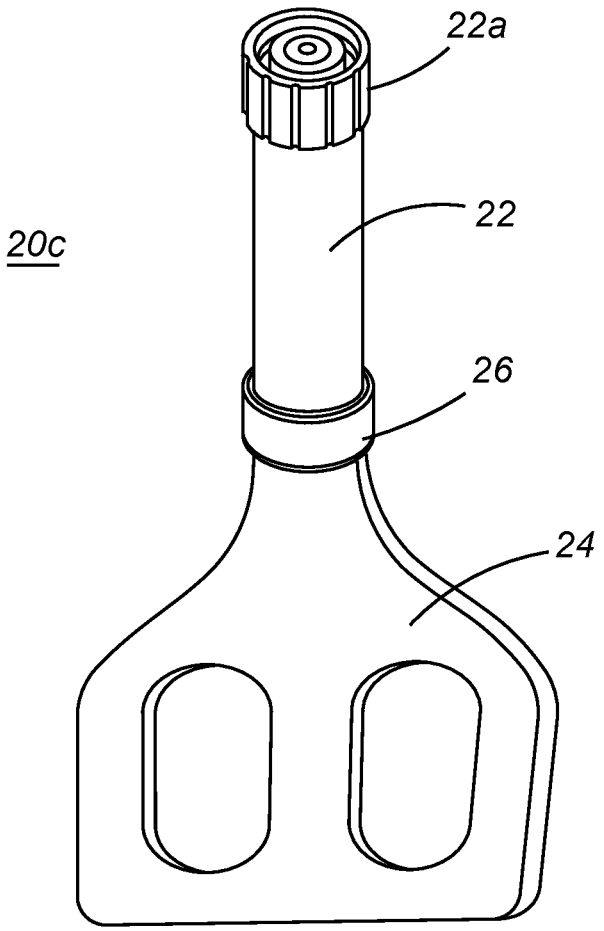

FIG. 2A shows a tool 20 separate from mixer 10. FIG. 2B shows the tool 20 connected with mixer 10. FIGS. 6A, 6B, and 6C show three exemplary embodiments of tools 20*a*, 20*b*, 20*c*. FIG. 6A shows a whisk 20*a*. FIG. 6B shows a dough hook 20*b*. FIG. 6C shows a paddle blade 20*c*. Three such working structures are illustrated, but the disclosure is not limited to these structures and could include other structures known in the field of the invention. Each tool 20 has a handle 22 connected with a working structure 24.

According to one embodiment, handle 22 has a grip 22*a* formed at a proximal end. Grip 22*a* may include ribs, grooves, protrusions, bumps, and the like to facilitate a user, such as a child, to rotate the tool with respect to the mixer 10, as will be explained below. According to another embodiment, instead of, or in addition to ribs, grip 22*a* includes a high-friction coating, for example, polyurethane, to make it easier for a child to grasp and rotate the tool. A cylindrical portion 22*b* extends from grip 22*a* in the distal direction. Shoulder 26 is provided at the distal end of cylindrical portion 22*b*. According to one embodiment, cylindrical portion 22*b* has a diameter equal to or slightly smaller than holder diameter D defined by slot 14*a* and semicircular portion 16*a*. The diameter of cylindrical portion 22*b* is somewhat larger than the space between ramp 16*c* and the surface of extension 14 so that handle 22 can be snapped into the space between semicircular portion 16*a* and slot 14*a* and held securely to extension 14. According to this embodiment, grip 22*a* and shoulder 26 have diameters larger than holder diameter D.

Handle 22 of each of tools 20*a*, 20*b*, and 20*c* are sized and shaped to snap into clip 16 and to be held against slot 14*a* of extension 14 and are able to rotate with respect to the mixer 10 to simulate mixing ingredients. In use, cylindrical portion 22*a* of a selected tool 20*a*, 20*b*, 20*c* is oriented with handle 22 upward. Cylindrical portion 22*b* is pressed against ramp 16*c* and the surface of extension 14, deflecting clip 16 away from extension 14 to allow the cylindrical portion 22*b* to move into the space defined by semicircular portion 16*a* and slot 14*a*. The diameters of grip 22*a* and shoulder 26 are larger than holder diameter D, so that the distal surface of grip 22*a* rests against the top edge of clip 16 and extension 14. The recoil force of the elastically deflected clip 16 presses the semicircular portion 16*a* against a portion of the handle. The force applied by clip 16 against cylindrical portion 22*a* of handle 22 securely holds tool 20 on extension 14. The diameter of cylindrical portion 22*b* is equal to, or somewhat smaller than holder diameter D so that a user can grasp grip 22*a* and rotate the selected tool 20*a*, 20*b*, 20*c*. As shown in FIG. 2B, tool 20 rotates around spin axis 18. The length of cylindrical portion 22*b* may be selected so that, when tool 20 is engaged with mixer 10, shoulder 26 is a short distance below the bottom edge of extension 14 so that vertical motion of tool 20 tool along spin axis 18 is limited.

Figure 4:
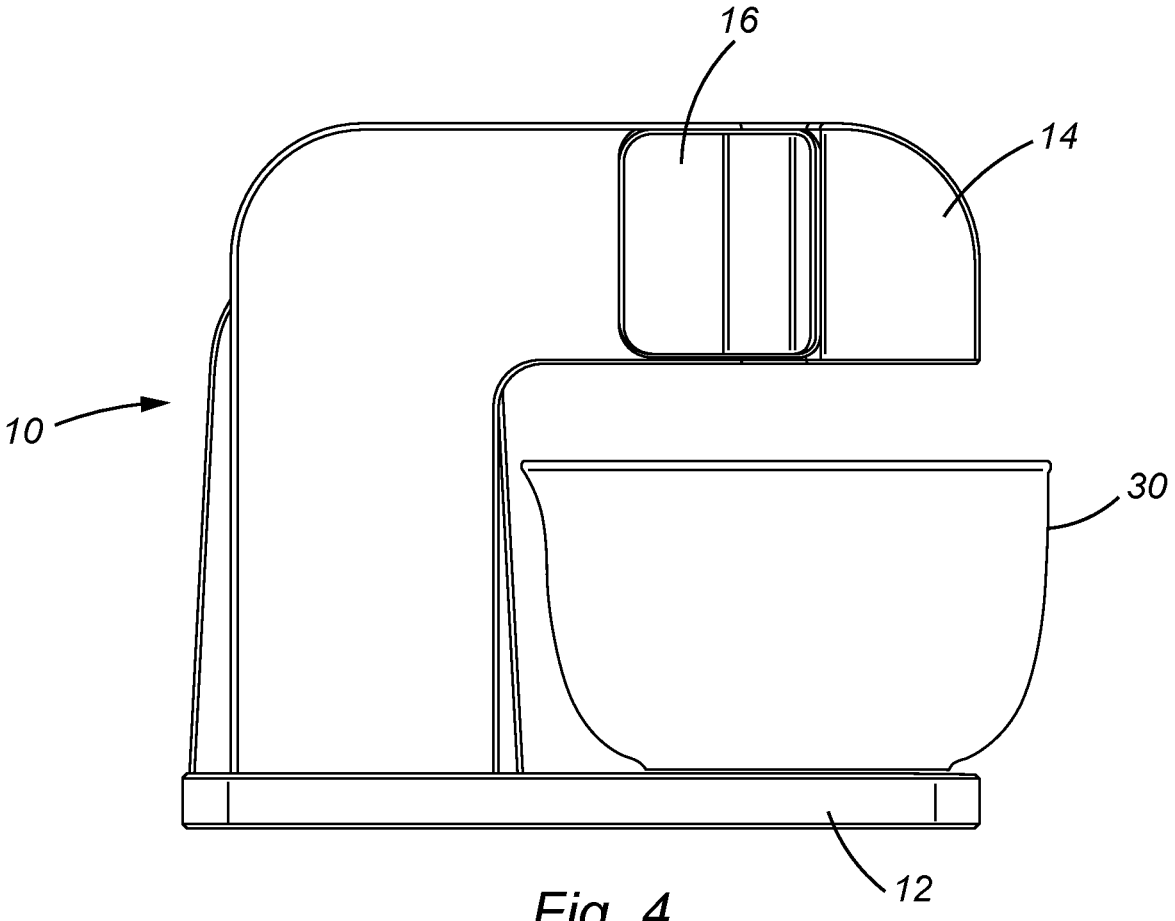
FIG. 4 is a side view of the stand mixer of FIG. 1.

According to one embodiment, bowl 30 is provided with stand mixer 10. Bowl 30 is sized to fit on base 12 below extension 14, as shown in FIGS. 2B and 4. When bowl 30 is placed on base 12 and tool 20 is inserted into clip 16, working structure 24 is positioned within bowl 30. According to one embodiment as shown in FIG. 3, base 12 includes a bowl engaging mechanism 12*a*, for example, a cavity sized and shaped to hold a bottom surface of bowl 30 in relation to tool 20. Cavity 12*a* is positioned so that spin axis 18 defined by semicircular portion 16*a* and slot 14*a* is positioned above the bowl.

Tool 20 is removed from clip 16 by pulling the tool outward through the space between ramp 16*c* and the surface of extension 14. Clip 16 flexes away from extension 14, allowing cylindrical portion 22*b* to fit through the space to remove tool 20 from mixer 10. The user can then select a different tool 20*a*, 20*b*, 20*c* to attach to the mixer.

Figure 5:
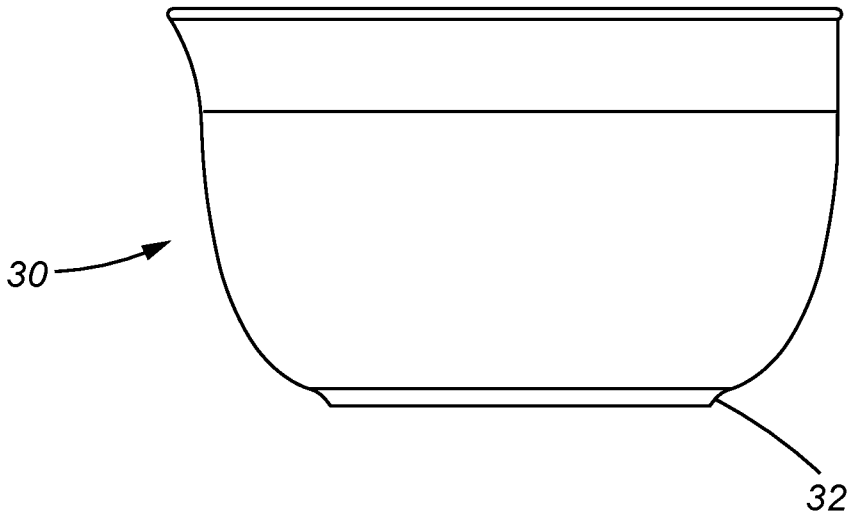
FIG. 5 is a side view of a bowl shaped to removably connect with a simulated stand mixer according to embodiments of the disclosure.

As shown in FIG. 5, according to one embodiment bowl 30 includes a ring or extension 32 on its outside bottom surface. Ring 32 is sized to fit into cavity 12*a*. This arrangement allows bowl 30 to be rotated by the user to simulate operating a stand mixer.

Figure 7:
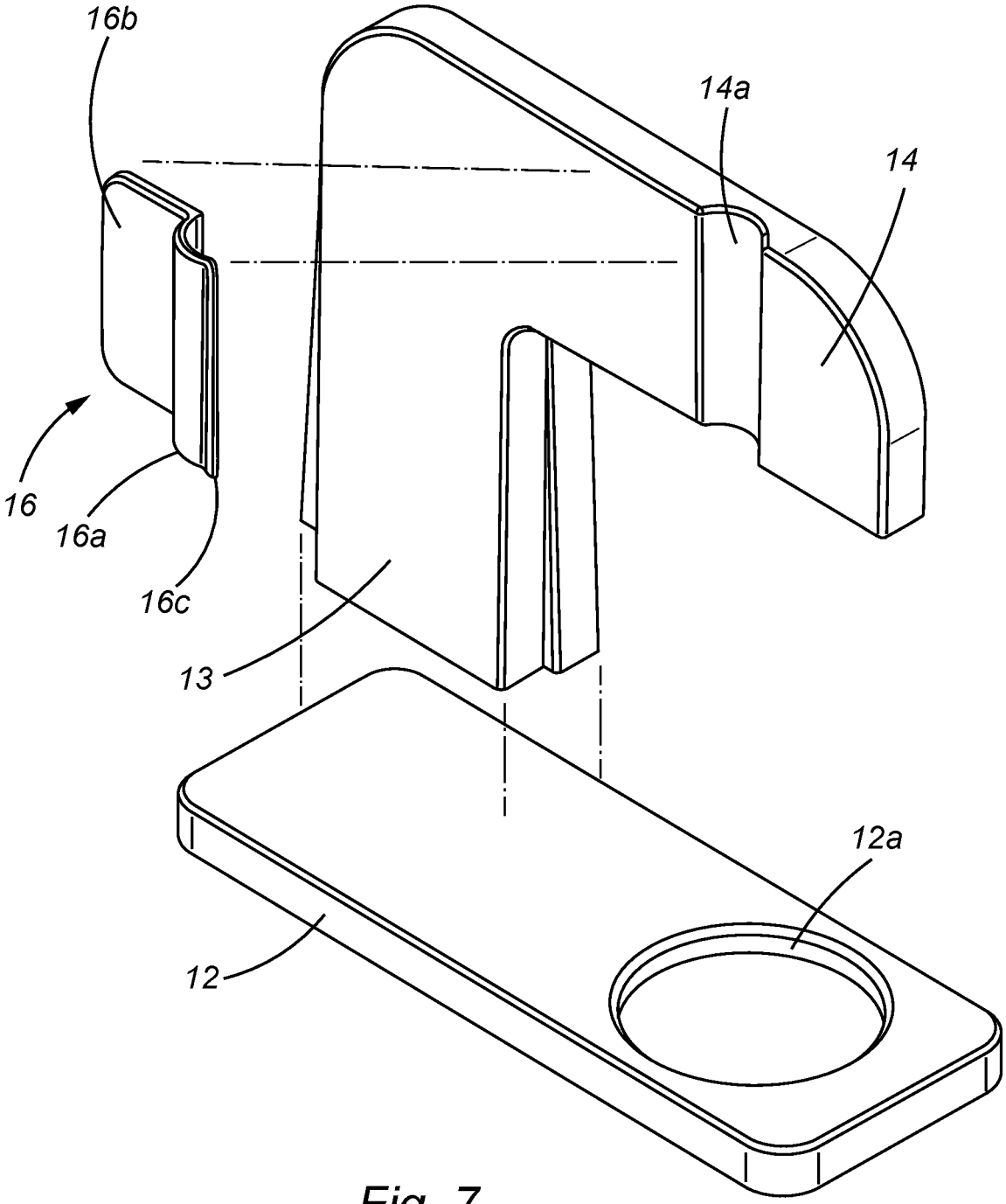
FIG. 7 is an exploded view of a simulated stand mixer according to embodiments of the disclosure.

FIG. 7 shows an exploded view of a simulated stand mixer 10 according to embodiments of the disclosure. Base 12 is formed from a flat section of material. Cavity 12*a* is formed in the surface of base 12, for example, by milling, routing, or molding. Vertical member 13 is connected with base 12. According to one embodiment, vertical member is connected with base using one or more of an adhesive, a fastener, and a woodworking joint, such as a mortise-and-tenon joint. Extension 14 is connected with vertical member 13. According to one embodiment, extension 14 is formed integrally with vertical member 13, for example, by cutting both vertical member 13 and extension 14 from a single sheet of material. Slot 14*a* is formed on the side of extension 14, for example, by milling, routing, or molding. According to one embodiment, base 12, vertical member 13, and extension 14 are formed from one or more of wood, plywood, particle board, plastic, a metal, or other solid material. According to a preferred embodiment, base 12, vertical member 13, and extension 14 are formed from plywood.

Clip 16 is joined with extension 14. According to one embodiment, clip 16 includes platen 16*b*. Platen 16*b* is connected with the side of extension 14 by an adhesive, a fastener, a snap fit engagement, an interference fit, a weld, or other fastening means known in the field of the invention. According to a preferred embodiment, platen 16*b* is connected with extension 14 by a layer of adhesive. Clip 16 is formed from a flexible material with a selected elastic modulus so that semicircular portion 16*a* and ramp 16*c* can flex away from extension 14 to allow insertion and removal of tool 20 from mixer 10. Clip 16 may be formed from one or more of a metal and a polymer. According to a preferred embodiment, clip 16 is formed from an impact resistant polymer such as acrylonitrile butadiene styrene (ABS).

Figure 8:
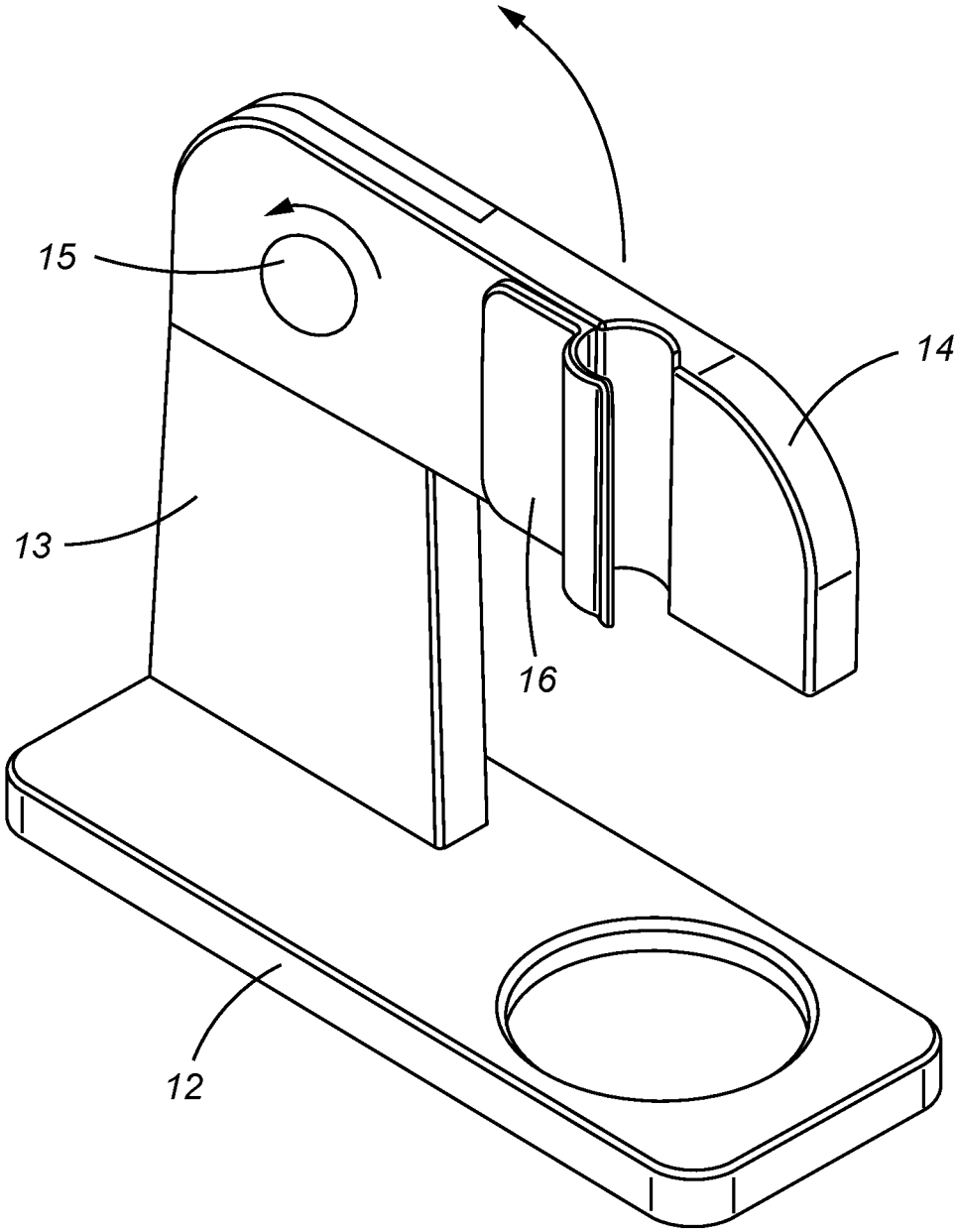
FIG. 8 is a perspective view of a simulated stand mixer according to a further embodiment of the disclosure.

According to another embodiment, shown in FIG. 8, vertical member 13 and extension 14 are formed separately and joined by a hinge 15. According to this embodiment, extension 14 can pivot about hinge 15 to lift extension 14 away from base 12.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims. Therefore, the description should not be construed as limiting the scope of the invention.

What is claimed is:

1. A simulated stand mixer comprising:

a base;

a vertical member extending from the base in a vertical direction;

an extension connected with the vertical member and extending in a horizontal direction including a semicircular slot having a center of curvature aligned with a spin axis, wherein the extension is separated from the base by a bowl space;

a clip connected with the extension, wherein the clip comprises a semicircular portion and a connecting portion, wherein the semicircular portion has a center of curvature along the spin axis, wherein the spin axis extends through the bowl space in the vertical direction, wherein the semicircular portion and the semicircular slot define a holder diameter, and wherein the connecting portion is connected with a side surface of the extension; and a tool, wherein the tool comprises:

a working structure at a distal end of the tool; and a cylindrical portion extending in a proximal direction from the working structure, wherein the cylindrical portion has a diameter equal to or less than the holder diameter, wherein the cylindrical portion is received between the semicircular portion of the clip and the semicircular slot of the extension within the holder diameter, wherein engagement of the cylindrical portion between the clip and the extension holds the tool colinear with the spin axis and allows the tool to spin about the spin axis.

2. The mixer of claim 1, wherein the connecting portion of the clip is connected with the extension by one or more of an adhesive, a fastener, a snap fit engagement, an interference fit, and a weld.

3. The mixer of claim 2, wherein the connecting portion comprise a platen, wherein the platen is connected with the extension by an adhesive layer.

4. The mixer of claim 1, wherein the cylindrical portion defines a portion of a handle for the tool.

5. The mixer of claim 1, wherein the working structure comprises a whisk, a dough hook, and a paddle.

6. The mixer of claim 4, wherein the handle further comprises a grip at a proximal end of the cylindrical portion, wherein a diameter of the grip is larger than the holding diameter, and wherein, when the cylindrical portion is engaged between the clip and the extension, the grip is positioned above a top edge of the extension or the semicircular portion.

7. The mixer of claim 6, wherein the handle further comprises a shoulder at a distal end of the cylindrical portion, wherein, when the cylindrical portion is engaged between the clip and the extension, the shoulder cooperates with a bottom edge of the extension or the clip to limit motion of the tool along the spin axis.

8. The mixer of claim 6, wherein the grip comprises a surface feature.

9. The mixer of claim 8, wherein the surface feature comprises one or more of ribs, grooves, or bumps.

10. The mixer of claim 8, wherein the surface feature comprises a high-friction coating.

11. The mixer of claim 1, further comprising a bowl, wherein the bowl is sized to fit in the space between the extension and the base.

12. The mixer of claim 11, wherein the base further comprises a bowl engagement on a top surface of the base beneath the space, and wherein the bowl connects with the bowl engagement to position the bowl along the spin axis.

13. The mixer of claim 12, wherein the bowl comprises a ring or disk on a bottom surface of the bowl, wherein the ring or disk is shaped to engage with the bowl engagement of the base to rotatably position the bowl on the base.

* * * * *